US007711311B2

(12) United States Patent
Watanabe et al.

(10) Patent No.: US 7,711,311 B2
(45) Date of Patent: May 4, 2010

(54) IMAGE FORMING APPARATUS WITH TRANSPARENT WINDOW IN SHEET RECEIVING SURFACE

(75) Inventors: Toshihiko Watanabe, Osaka (JP); Tasuku Chihara, Osaka (JP)

(73) Assignee: Kyocera Mita Corporation (JP)

( * ) Notice: Subject to any disclaimer, the term of this patent is extended or adjusted under 35 U.S.C. 154(b) by 303 days.

(21) Appl. No.: 11/968,858

(22) Filed: Jan. 3, 2008

(65) Prior Publication Data

US 2008/0166141 A1 Jul. 10, 2008

(30) Foreign Application Priority Data

Jan. 10, 2007 (JP) ..... 2007-002460
Jan. 10, 2007 (JP) ..... 2007-002461

(51) Int. Cl.
*G03G 15/00* (2006.01)

(52) U.S. Cl. ..... 399/405; 399/13

(58) Field of Classification Search ..... 399/405, 399/13, 24, 107; D18/49
See application file for complete search history.

(56) References Cited

U.S. PATENT DOCUMENTS 4,420,149 A * 12/1983 Schultes et al. ..... 271/9.09
4,540,166 A * 9/1985 Massengeil et al. ..... 271/3.01
4,730,206 A * 3/1988 Sawada et al. ..... 399/405
7,290,952 B2 * 11/2007 Kagami ..... 400/693
2006/0008292 A1 1/2006 Watanabe

FOREIGN PATENT DOCUMENTS

JP 02210371 A * 8/1990
JP 2003201046 A * 7/2003
JP 2006-23347 1/2006
JP 2006203562 A * 8/2006

* cited by examiner

*Primary Examiner*—David M Gray
*Assistant Examiner*—Billy J Lactaoen
(74) *Attorney, Agent, or Firm*—Gerald E. Hespos; Michael J. Porco

(57) ABSTRACT

An image forming apparatus has a main body with a casing and performs an image forming operation. A sheet receiving surface constitutes part of the casing and can receive a sheet discharged after an image forming process is performed. A window is provided on the sheet receiving surface for enabling part of the interior of the main body to be seen. An auxiliary tray is attached to the sheet receiving surface and is displaceable between an unfolded position to auxiliary support a discharged sheet and an accommodated position to be accommodated in the sheet receiving surface. The window is at a bottom of a recess formed by recessing a part of the sheet receiving surface. The auxiliary tray is accommodated in the recess when at the accommodated position and includes a transparent portion for ensuring visibility of the window.

10 Claims, 11 Drawing Sheets

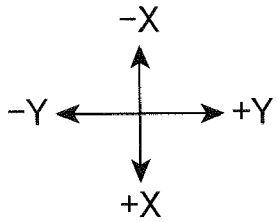
FIG.6A FIG.6B FIG.6C FIG.6D FIG.6E
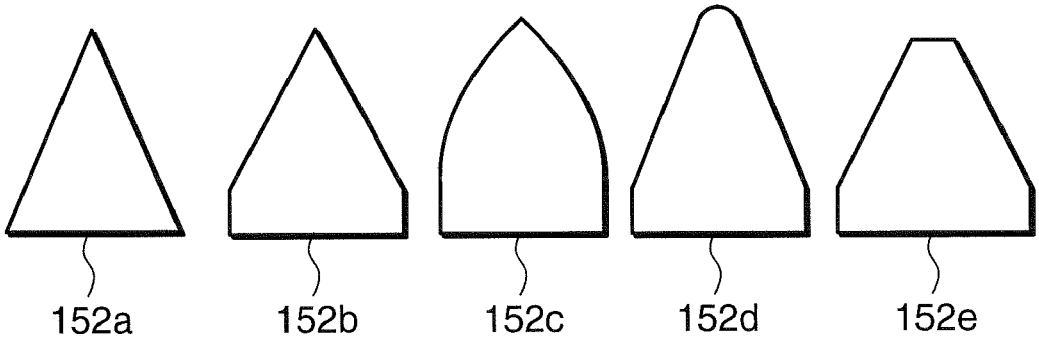

IMAGE FORMING APPARATUS WITH TRANSPARENT WINDOW IN SHEET RECEIVING SURFACE

BACKGROUND OF THE INVENTION

1. Field of the Invention

The present invention relates to an image forming apparatus such as a printer, a copier, a facsimile machine or a complex machine having functions of these apparatuses.

2. Description of the Related Art

An image forming apparatus such as a printer includes a developing mechanism for supplying toner particles to an image bearing member and a toner container for replenishing the developing mechanism with the toner particles. This toner container has a container main body for storing the toner particles and is normally detachably mounted in a main body of the image forming apparatus so as to be replaceable as the toner is used up. This holds true for an ink cartridge of the ink-jet type in a printer or the like.

Generally, an image forming apparatus has a casing structure, and component members such as the above image bearing member, developing mechanism and toner container are accommodated in the casing so as not to be visible from the outside (see, for example, Japanese Unexamined Patent Publication NO. 2006-23347). Upon replacing the toner container, a user opens an opening cover of the casing, takes the used toner container out from the inside of the casing, mounts a new toner container and closes the opening cover. The user can see the toner container only when the opening cover is open.

A printer or the like includes a sheet receiving surface for receiving a sheet discharged after an image forming process. For example, in a small-size printer generally used in an office or the like, an auxiliary tray is attached to this sheet receiving surface in many cases. This auxiliary tray is used to auxiliary support sheets upon discharging large-size sheets to the sheet receiving surface or for an improvement in the alignment of sheets.

In a conventional image forming apparatus, a user cannot know which toner container is actually mounted with the opening cover closed. In other words, the manufacturer and model number of the toner container mounted in the main body of the image forming apparatus cannot be known, and the opening cover had to be opened in order to know these. Accordingly, the user had to confirm the model number and the like by opening the opening cover every time despite its cumbersomeness, for example, in the case of ordering a new toner container or in the case of being required to notify the model number of the toner container at the time of requesting maintenance.

Accordingly, it is normally thought to provide a window on a sheet receiving surface of a printer located at a position easy to see by a user so that the user can see a part of a mounted toner container from the outside. However, the auxiliary tray is attached to the sheet receiving surface in many cases as described above and, if the window is additionally provided, it is not preferable in terms of design since the sheet receiving surface becomes unnecessarily complicated to impair an aesthetic impression.

SUMMARY OF THE INVENTION

An object of the present invention is to provide an image forming apparatus capable of avoiding making a sheet receiving surface look complicated while enabling a user to see a consumable supplying member such as a toner container or an ink cartridge mounted in an image forming apparatus main body to be seen from the outside.

In order to accomplish this object, one aspect of the present invention is directed to an image forming apparatus, comprising an apparatus main body having a casing structure and adapted to perform an image forming operation; a sheet receiving surface constituting a part of the casing structure and adapted to receive a sheet discharged after an image forming process is performed in the apparatus main body; a window provided on the sheet receiving surface for enabling a part of the interior of the apparatus main body to be seen; and an auxiliary tray attached to the sheet receiving surface and displaceable between an unfolded position to auxiliary support a discharged sheet and an accommodated position to be accommodated in the sheet receiving surface, wherein the window is provided at a bottom surface of a recess formed by recessing a part of the sheet receiving surface, and the auxiliary tray is accommodated in the recess when being located at the accommodated position and includes a transparent portion for ensuring the visibility of the window.

BRIEF DESCRIPTION OF THE DRAWINGS

FIGS. 6A to 6E are schematic top views showing variations of the shape of a window.

DETAILED DESCRIPTION OF THE PREFERRED EMBODIMENTS

Hereinafter, embodiments of the present invention are described with reference to the accompanying drawings.

Figure 1:
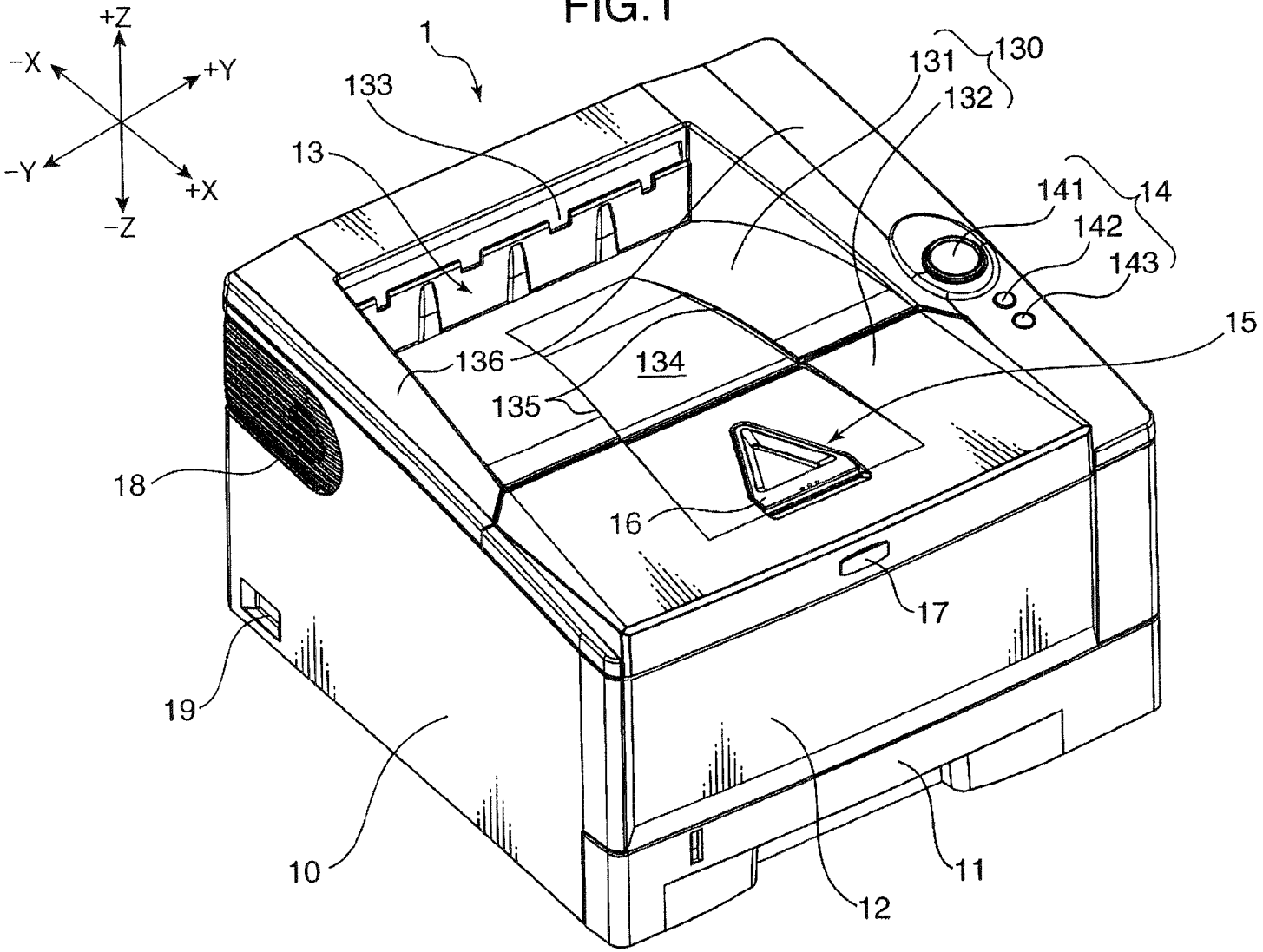
FIG. 1 is a perspective view showing the external appearance of a printer according to a first embodiment of the invention.

FIG. 1 is a perspective view showing the external appearance of a printer 1 according to one embodiment of an image forming apparatus (apparatus for receiving a consumable supplying member) of the present invention. In FIG. 1, X-X directions are forward and backward directions, Y-Y directions are transverse directions, and Z-Z directions are vertical directions, wherein +X direction is forward direction; −X direction backward direction; +Y direction rightward direction; −Y direction leftward direction; +Z direction upward direction; and −Z direction downward direction. This holds true for other figures affixed with direction indicators.

The printer 1 (image forming apparatus) performs an image forming operation and an image transferring operation based on image information inputted from an external apparatus such as a personal computer. The printer 1 is constructed such that various devices for image formation are mounted in an apparatus main body 10 having a casing structure in the form of a quadrangular prism.

A sheet cassette 11 is mounted at the bottom of the front surface of the apparatus main body 10. The sheet cassette 11 is a drawer container for storing a sheet stack P1 (see FIG. 2) as a collection of sheets P to which images are transferred, and is detachably mounted in the apparatus main body 10.

A manual sheet feeder 12 is provided above the sheet cassette 11. The manual sheet feeder 12 includes a rectangular plate-like member and has the bottom end thereof mounted in such a manner as to be rotatable relative to the front part of the apparatus main body 10, thereby being able to be opened and closed relative to the apparatus main body 10 (see FIG. 2). A user can feed a sheet by setting this manual sheet feeder 12 in an open state in the case of wishing manual sheet feed instead of automatic sheet feed from the sheet cassette 11. The outer surface of the manual sheet feeder 12 serves as a decorative plate for the front part of the apparatus main body 10.

A discharge unit 13 is provided on the upper surface of the apparatus main body 10. The discharge unit 13 is formed by partly recessing the upper surface of the apparatus main body 10 and receives a printed sheet on the recessed bottom surface (sheet receiving surface 130). The sheet receiving surface 130 is formed by a curved plate 131 located at the back side of the upper surface of the apparatus main body 10 and an opening cover 132 located at the front side.

The curved plate 131 has such a moderately curved surface that the downward inclination thereof gradually increases from the front side toward the back side and a part adjacent to a sheet discharge port 133 is at the lowest position. The opening cover 132 is a flat member and assembled in a state moderately inclined down so as to be connected with the front end edge of the curved plate 131. With such a discharge unit 13, a plurality of sheets discharged from the sheet discharge port 133 have the trailing ends thereof in a conveying direction aligned near the sheet discharge port 133 by the inclination of the sheet receiving surface 130.

Figure 3:
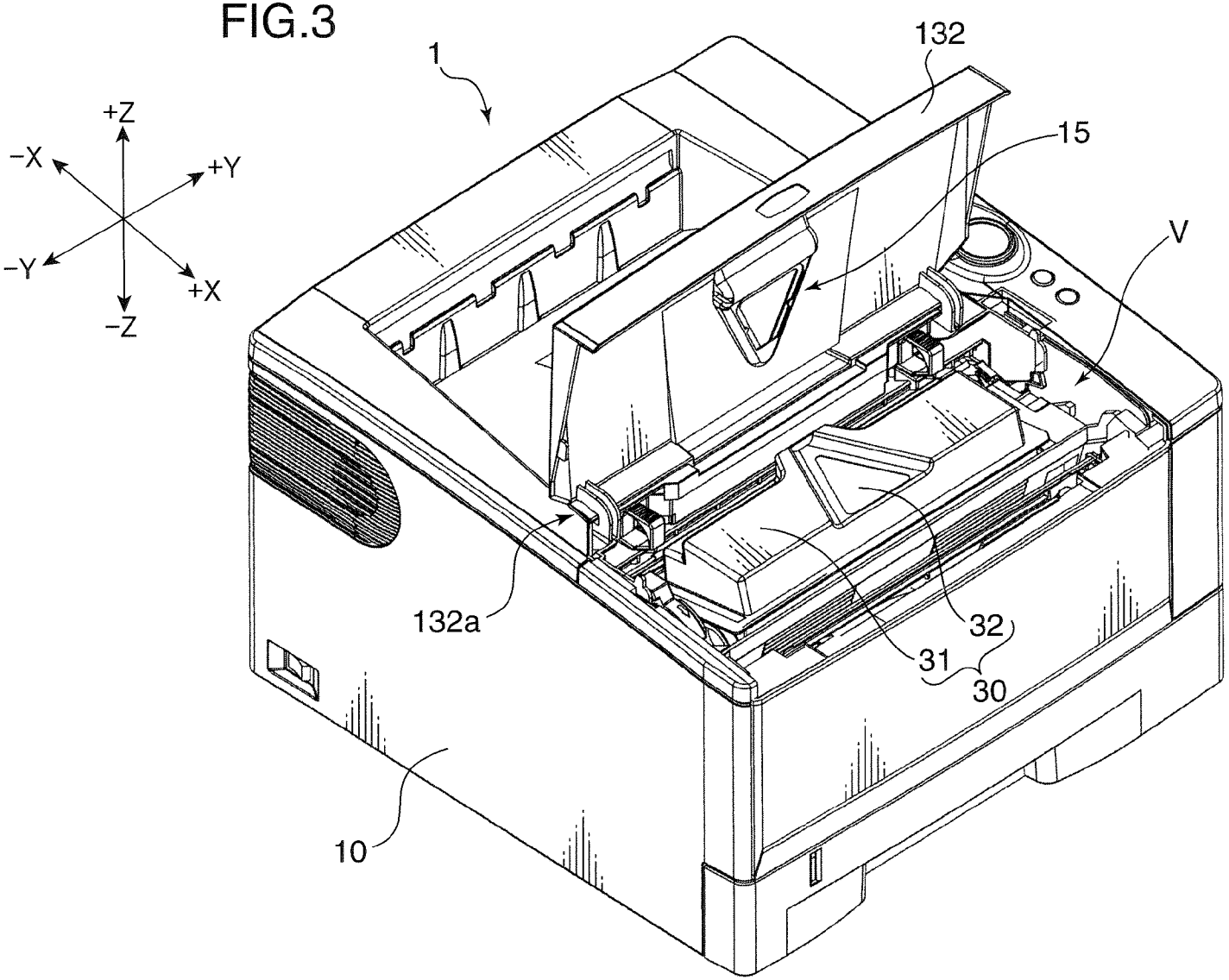
FIG. 3 is a perspective view showing a state where a toner container is mounted in an apparatus main body.
Figure 4:
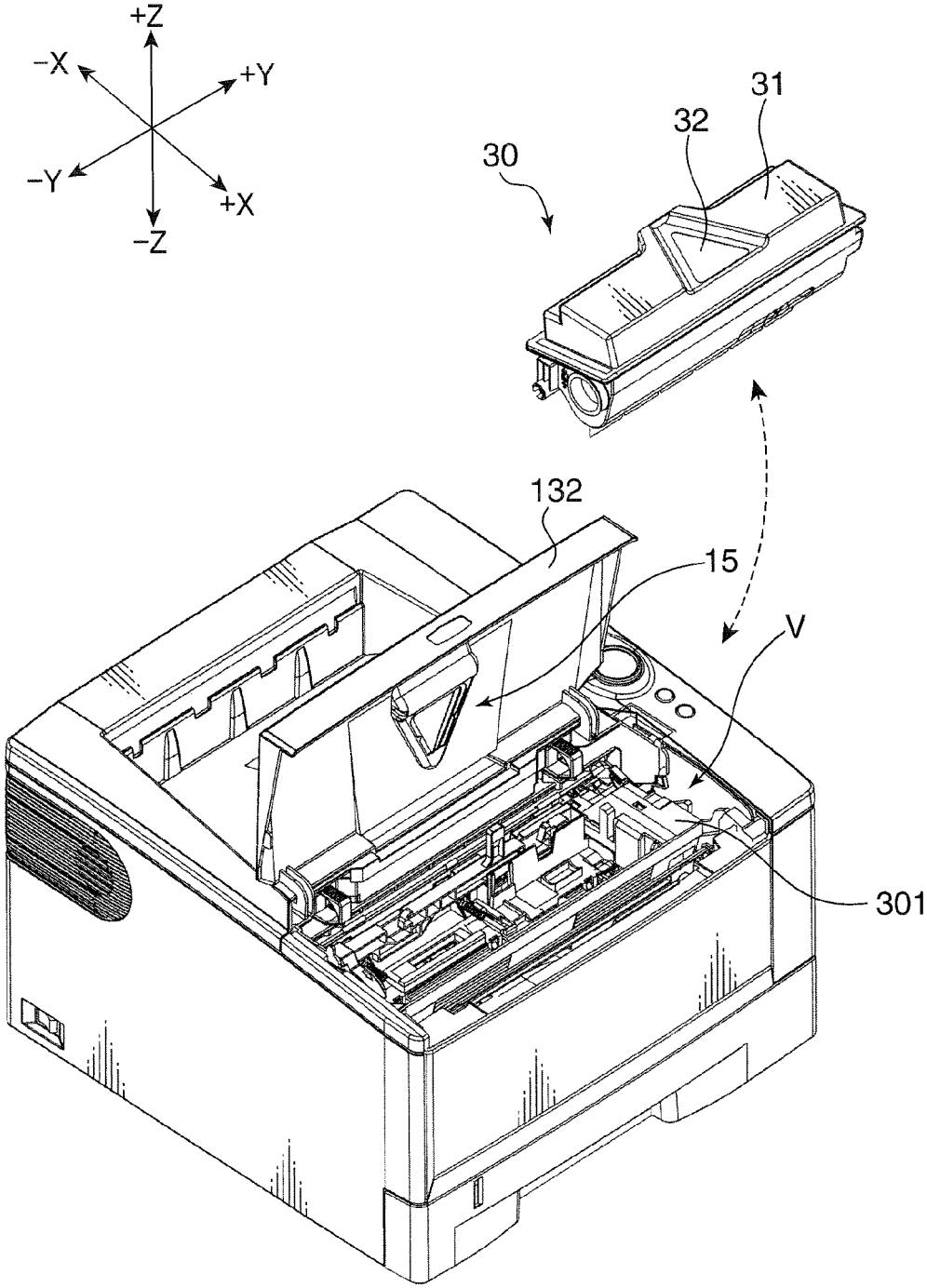
FIG. 4 is a perspective view showing a state where the toner container is detached from the apparatus main body.

The opening cover 132 is opened upward with the rear end edge thereof as an axis of rotation (see FIGS. 3 and 4). The opening cover 132 is opened and closed upon replacing a toner container 30. Further, a confirmation portion 15 including a window 152 (see FIG. 5) enabling a part of the toner container 30 to be seen is provided in the transverse center of the opening cover 132. A triangular auxiliary tray 16 is mounted on the confirmation portion 15. These are described in detail later.

The sheet receiving surface 130 is formed with a recessed surface 134 extending in forward and backward directions from the curved plate 131 to the opening cover 132. This recessed surface 134 is for reducing the contact resistance of a sheet with the sheet receiving surface 130 and ensuring smooth sheet discharge. The recessed surface 134 has left and right lateral steps 135 widened from the back side toward the front side. Similarly, the sheet receiving surface 130 is widened from the back side toward the front side, and upper walls 136 located at the left and right sides of the sheet receiving surface 130 are narrowed from the back side toward the front side. Accordingly, the depth and aerodynamic surface shape created by the presence of the above lateral steps 135 and upper walls 136 give a stylish and speedy aesthetic impression to the user operating (seeing) from the front side of the apparatus main body 10.

An operation panel unit 14 is provided on the right upper wall 136. The operation panel unit 14 is for receiving the operation of the user to the printer 1 and displaying information on the operation of the printer 1. Here is illustrated the operation panel unit 14 provided with a display 141 including an indicator for displaying stored states of sheets and toner particles and an occurrence of a jam, a cancel key 142 for interrupting a printing operation and a start key 143 for instructing a printing operation. Besides the above, a manufacturer emblem 17 is provided on the outer front surface of the apparatus main body 10, and a vent 18 and a power switch 19 are respectively provided on the left surface.

As described above, an outer casing (casing) of the apparatus main body 10 is partly constructed by decorative surfaces (front surfaces) of the sheet cassette 11 and the manual sheet feeder 12 and the sheet receiving surface 130 (upper surface) of the discharge unit 13. The color of the outer casing may be a monochromatic color such as an ivory color, but it is preferable to let, for example, the sheet receiving surface 130 or the decorative surface of the manual sheet feeder 12 and the sheet receiving surface 130 have a deeper (darker) color as compared to other parts. By doing so, it is possible not only to improve the design by two-tone colors, but also to make the sheet discharged onto the sheet receiving surface 130 easily recognizable by the user. In this case, the color of the sheet receiving surface 130 and the like may be, for example, 2 or smaller in lightness represented by Munsell values of the Munsell chart (JIS) and a difference in lightness between the color of the sheet receiving surface 130 and the like and that of the other parts may be 3 or greater in the Munsell value of the Munsell chart (JIS).

Figure 2:
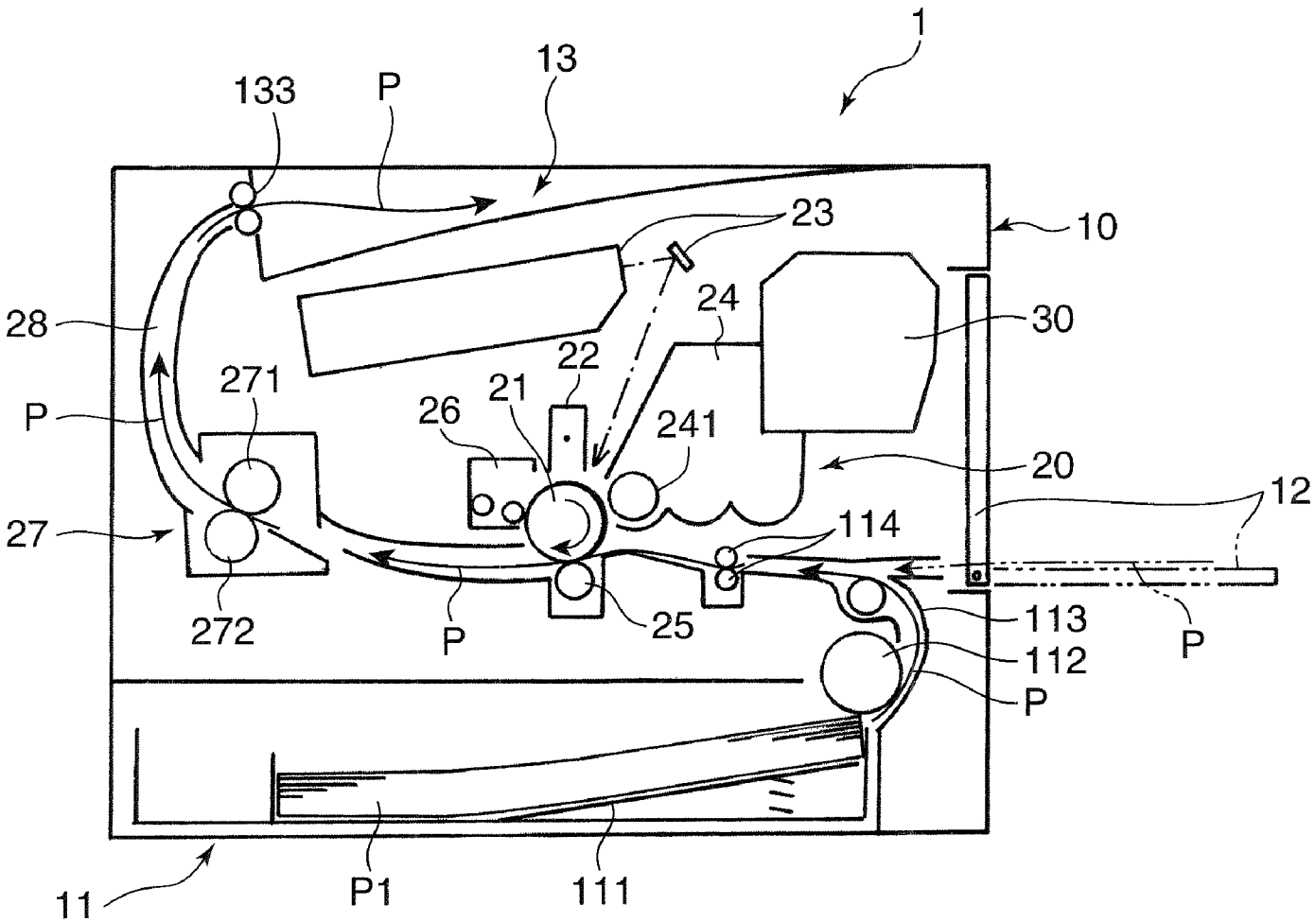
FIG. 2 is a schematic lateral section of the printer of FIG. 1 along forward and backward directions.

Next, the internal construction of the printer 1 is described. FIG. 2 is a schematic lateral section of the printer of FIG. 1 along forward and backward directions. The printer 1 includes the aforementioned sheet cassette 11, an image forming assembly 20 and a fixing device 27 in the apparatus main body 10. The sheet cassette 11 stores the stack P1 of sheets used for printing. The image forming assembly 20 performs an image transfer process to sheets P fed one by one from the sheet stack P1 stored in the sheet cassette 11 or fed from the aforementioned manual sheet feeder 12. The fixing device 27 applies a fixing process to the sheet P having the image transfer process applied thereto.

A lifter 111 is provided in the sheet cassette 11 to lift up a dispensing end (downstream end) of the sheet stack P1. A pickup roller 112 for dispensing the sheets P one by one from the sheet stack P is provided at the downstream end of the sheet cassette 11, and the end of the sheet stack P1 lifted up by the lifter 111 is held in contact with the pickup roller 112. The sheet P dispensed by the driving of this pickup roller 112 is fed to the image forming assembly 20 via a sheet conveyance path 113 and a pair of registration rollers 114 disposed at the downstream end of the sheet conveyance path 113. The sheet P fed from the manual sheet feeder 12 is conveyed to the pair of registration rollers 114 via an unillustrated feed roller.

The image forming assembly 20 transfers a toner image to the sheet P based on an image data given from an external apparatus. The image forming assembly 20 includes a photoconductive drum 21 rotatably provided about a drum center axis extending in transverse direction, and a charger 22, an exposing device 23, a developing device 24 (developing mechanism), a transfer roller 25 and a cleaning device 26 arranged along the circumferential surface of the photoconductive drum 21.

The photoconductive drum 21 is for forming an electrostatic latent image and a toner image in conformity with this electrostatic latent image on the circumferential surface thereof. An amorphous silicon photoconductive drum having an amorphous silicon layer formed on the circumferential surface thereof is suitably used as the photoconductive drum 21.

The charger 22 is for uniformly charging the circumferential surface of the photoconductive drum 21 rotating clockwise about the drum center axis. Here, a charger of the type to impart electric charges to the circumferential surface of the photoconductive drum 21 by corona discharge is illustrated as the charger 22. Instead of such a charger 22, a charging roller for imparting electric charges to the photoconductive drum 21 while being rotated by the photoconductive drum 21 with the circumferential surface thereof held in contact with the circumferential surface of the photoconductive drum 21 may be used.

The exposing device 23 irradiates the circumferential surface of the rotating photoconductive drum 21 with a laser beam modulated based on the image data. Electric charges are removed from parts of the circumferential surface of the photoconductive drum 21 irradiated with the laser beam, whereby an electrostatic latent image in conformity with a laser beam irradiation pattern is formed on the circumferential surface of the photoconductive drum 21.

The developing device 24 supplies toner particles to the circumferential surface of the photoconductive drum 21 via a developing roller 241 built therein. When the toner particles are supplied to the photoconductive drum 21, it is attached to a part where the electrostatic latent image is formed, whereby a toner image is formed on the circumferential surface of the photoconductive drum 21. The toner container is detachably attached to the developing device 24, and toner particles are replenished from this toner container when the toner particles in the developing device 24 are used up.

The transfer roller 25 forms a nip portion together with the photoconductive drum 21 and transfers the toner image formed on the circumferential surface of the photoconductive drum 21 to a sheet P fed to the nip portion. The toner image on the circumferential surface of the photoconductive drum 21 is positively charged. On the other hand, the transfer roller 25 imparts negative electric charges having a polarity opposite to the electric charges of the toner image to the sheet P. The positively charged toner image on the circumferential surface of the photoconductive drum 21 is peeled off toward the front side of the negatively charged sheet P to be transferred to the sheet P.

The cleaning device 26 cleans the circumferential surface of the photoconductive drum 21 by removing the toner residual thereon after the transfer process. The circumferential surface of the photoconductive drum 21 cleaned by this cleaning device 26 moves toward the charger 22 again for a next image forming process.

The fixing device 27 is for fixing the toner image transferred to the sheet P in the image forming assembly 20 to the sheet P by heating. The fixing device 27 includes a heat roller 271 having an electric heating element mounted therein and a pressure roller 272 whose circumferential surface is opposed to that of the heat roller 271. The sheet P after the transfer process passes through a nip portion between the heat roller 271 driven to rotate and the pressure roller 272 rotated by the heat roller 271 in an opposite direction to have the fixing process applied thereto by obtaining heat from the heat roller 271. The sheet P having the fixing process applied thereto is discharged to the discharge unit 13 via a sheet discharge path 28. The sheet discharge path 28 is a conveyance path along which sheets P of the respective sizes are discharged with reference to a center line of a width direction (direction normal to a sheet conveying direction) of the sheet receiving surface 130.

FIGS. 3 and 4 are perspective views showing a mounted state of the toner container (consumable supplying member) in the apparatus main body 10, wherein FIG. 3 shows a state where the toner container 30 is mounted in the apparatus main body 10 (developing device 24) and FIG. 4 shows a state where the toner container 30 is detached from the apparatus main body 10.

In the case of replacing the toner container 30, the user grips the front end of the opening cover 132 and lifts it upward to turn the opening cover 132 by about 90° about a rotary shaft 132*a*, whereby the opening cover 132 is set in an open state. By this operation, the toner container 30 mounted in an accommodation space V in the apparatus main body 10 is exposed as shown in FIG. 3.

Subsequently, the toner container 30 is taken out of the accommodation space V by lifting the left and right surfaces of the toner container 30 with both hands (see FIG. 4). Then, a new toner container 30 filled with toner particles is mounted in the accommodation space V. At this time, the toner container 30 needs to be mounted while being exactly positioned with an installation portion 301 provided on the upper surface of the developing device 24. In other words, the user needs to mount the toner container 30 in a correct installation direction, so that a toner outlet, a drive gear of an agitator and the like of the toner container 30 are positioned with a toner reception port, a driver of the agitator and the like of the installation portion 301. After the new toner container 30 is mounted, the opening cover 132 is closed.

In the printer 1 constructed as described above, the confirmation portion 15 is provided on the opening cover 132 in this embodiment to know the toner container 30 actually mounted in the apparatus main body 10 even when the opening cover 132 is closed and further to show a transverse center position of the discharge unit 13 (sheet receiving surface 130). Further, an indicator 32 (visual confirmation portion) arranged at a position facing the confirmation portion 15 with the toner container 30 mounted in the apparatus main body 10 is provided on the upper surface of a container main body 31 of the toner container 30. These constructions are described in detailed below.

Figure 5:
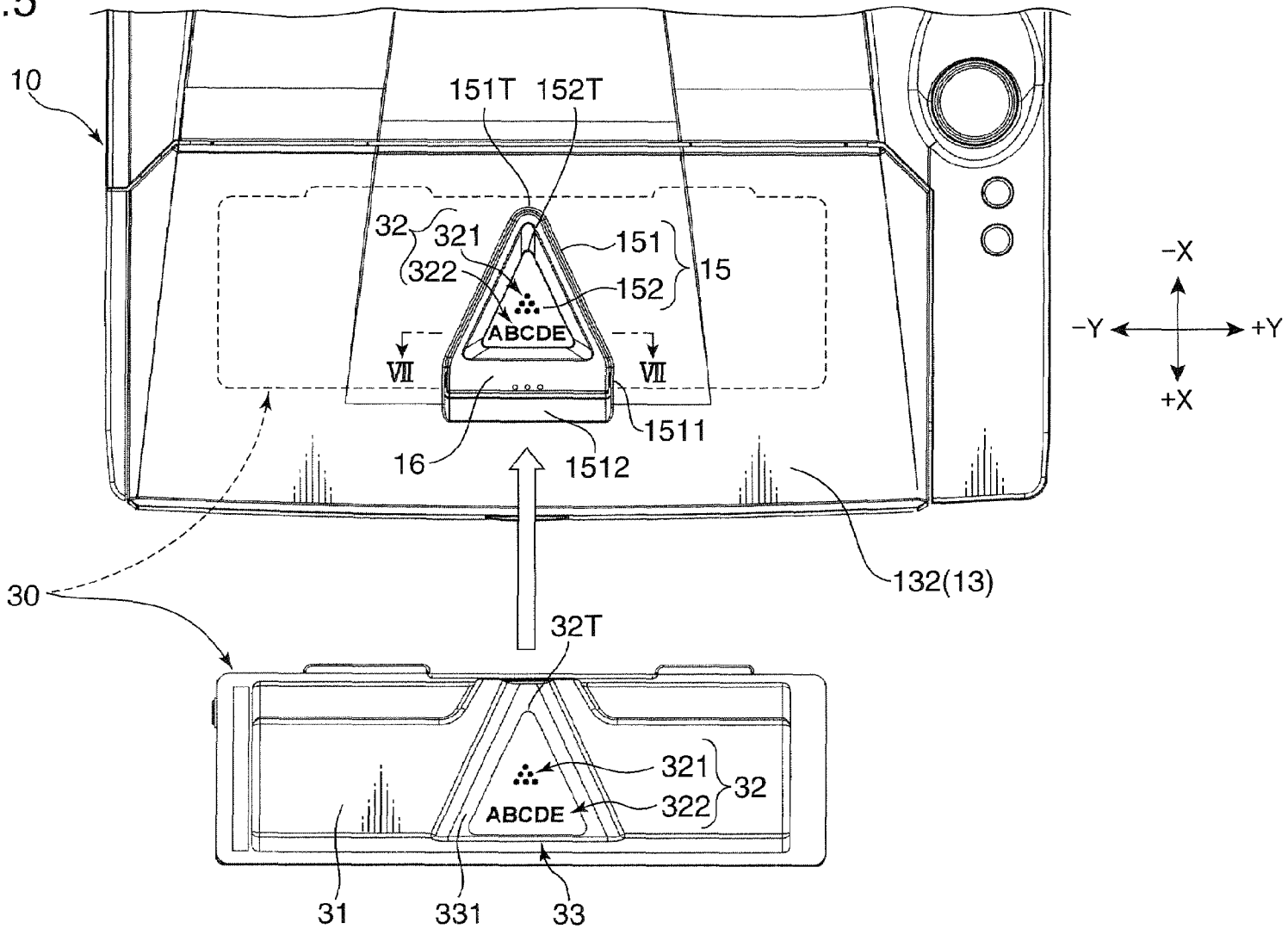
FIG. 5 is a top view of an opening cover and the toner container.

FIG. 5 is a top view of the opening cover 132 and the toner container 30. The confirmation portion 15 is provided at the center position of the opening cover 132 with respect to both transverse direction and forward and backward directions. In this embodiment, the confirmation portion 15 includes a window recess 151 formed by recessing the opening cover 132 at the above center position (recess formed by recessing a part of the casing) and a window 152 provided at the bottom surface of the window recess 151.

By providing the window 152 at the bottom surface of the window recess 151 instead of providing it in flush with the opening cover 132, the interference of the window 152 with sheets discharged to the discharge unit 13 and other objects can be suppressed and the window 152 can be prevented from being scratched and smeared. On the other hand, since the recess is present at the front side of the discharge unit 13 with respect to the sheet conveying direction, i.e. at a position where the user holds the sheet discharged to the discharge unit 13 for removal, there is an advantage that the user can easily hold a sheet end. Further, the user can grasp the widthwise center position of the sheet by recognizing the window recess 151 by touch.

For example, a transparent plastic plate can be used as the window 152. The window recess 151 is a recess substantially triangular when viewed from above and the window 152 has a triangular shape one size smaller than the window recess 151. Both shapes have directivities.

The window 152 has an isosceles triangular shape having a bottom side parallel to the front edge of the apparatus main body 10 and an apex 152T faced backward. The window recess 151 has an analogous isosceles triangular shape and includes a parallel section 1511 before the above bottom side and an inclined surface 1512 at the front side of the parallel section 1511. The parallel section 1511 is where a rotary shaft enable the upward rotation of the auxiliary tray 16 is formed. The inclined surface 1512 supports the auxiliary tray 16 rotated upward by a specified angle.

In a positional relationship with the discharge unit 13, the apex 152T of the window 152 and an apex 151T of the window recess 151 are located at the front side with respect to the sheet conveying direction and at the transverse center position of the sheet receiving surface 130. Further, the apices 151T, 152T are faced toward the rear side with respect to the sheet conveying direction. By having such a positional relationship, the user can know the widthwise center position of the sheet discharged to the discharge unit 13.

Accordingly, even if a multitude of sheets are stacked up on the sheet receiving surface 130 to form a thick sheet stack, the user can recognize the center of the sheet stack and grab the sheet stack at this center position in a well-balanced manner. Thus, even users having weak hands or users sitting on wheelchairs can stably remove the sheet stack from the sheet receiving surface 130 without disrupting a stacked state of the sheets.

In a relationship with the toner container 30, the apex 152T of the window 152 and the apex 151T of the window recess 151 are faced in the installation direction of the toner container 30 into the apparatus main body 10. In the printer 1 of this embodiment, the toner container 30 is installed from the front side of the apparatus main body 10 as shown in FIGS. 4 and 5. In order to simply show this installation direction of the toner container 30 to the user, the window 152 and the window recess 151 have transversely symmetric triangular shapes with the apices 152T, 151T thereof faced backward from the front side of the apparatus main body 10. Thus, the user can install the toner container 30 into the apparatus main body 10 by being navigated by the facing direction of the apices 152T, 151T and, therefore, it can be prevented to install the toner container 30 in a wrong mounting direction. Further, since the window 152 and the window recess 151 have symmetric shapes having the apices faced in the installation direction, design can be improved.

Variations of the shape of the window 152 (window recess 151) are shown in FIGS. 6A to 6E. A window 152*a* shown in FIG. 6A has an isosceles triangular shape similar to the window 152 shown in FIG. 5. A window 152*b* shown in FIG. 6B has a substantially triangular shape (or pentagonal shape) with a parallel extended section attached at the bottom side. A window 152*c* shown in FIG. 6C is shaped such that two sides extending to an apex are transversely symmetrical curves. A window 152*d* shown in FIG. 6D has a substantially triangular shape whose apex is a curve instead of an acute angle and which has a parallel extended section attached at the bottom side. A window 152*e* shown in FIG. 6E has a substantially triangular shape (or hexagonal shape) with an apex section parallel to the bottom side and a parallel extended section attached at the bottom side. In this way, the shape of the window 152 (window recess 151) preferably has a transversely symmetrical shape whose apex is formed by straight lines or curves to face in the installation direction of the toner container 30. However, the window 152 may also be shaped to have no directivity and may, for example, have a circular or rectangular shape.

The toner container 30 includes the container main body 31 and the indicator 32 provided on the upper surface of the container main body 31. The container main body 31 has a casing structure, and toner particles are stored inside. The agitator for agitating the toner particles, a conveyance screw for guiding the toner particles to the toner discharge port (not shown) formed in the bottom wall of the container main body 31 and the like are also provided in the container main body 31.

The indicator 32 is provided on the upper surface of the container main body 31 for displaying specified indication information. The indicator 32 is arranged at a position to face the confirmation portion 15 with the toner container 30 mounted in the apparatus main body 10. Further, the indicator 32 has an isosceles triangular shape having substantially the same size as the window 152 and is positioned in alignment with the correct mounting direction of the toner container 30 into the apparatus main body 10.

As shown in FIG. 5, the indicator 32 is provided on the upper surface of the container main body 31 so as to face and conform in shape to the window 152, i.e. so as to conform the apex 152T of the window 152 and an apex 32T of the indicator 32 when the toner container 30 is mounted into the apparatus main body 10 in the correct direction. In other words, the indicator 32 has a transversely symmetrical triangular shape having the apex 32T faced in the installation direction of the toner container 30 similar to the window 152. By letting the window 152 and the indicator 32 have directivities in this way, the user can easily notice an erroneous mounting based on a difference between the directivities of the window 152 and the indicator 32 in the case of attempting to mount the toner container 30 into the apparatus main body 10 in a wrong direction. The shapes illustrated in FIGS. 6A to 6E may also be adopted as variations of the shape of the indicator 32.

The indicator 32 may be a seal having an adhesive surface capable of adhering to the container main body 31 on the underside thereof or the like. In this embodiment is shown an example in which an indicator recess 33 substantially triangular when viewed from above is provided in the center of the upper surface of the container main body 31, and a seal for the indicator 32 is attached to a bottom surface 331 thereof. The indicator 32 includes a dingbat indicator 321 for displaying a dingbat indicating toner particles and a character indicator 322 indicating the manufacturer name ("ABCDE" in FIG. 5) as indication information. Besides, symbols other than characters may be displayed in the indicator 32. Instead of forming the indicator 32 of the seal or the like, a triangular indicator including the above dingbat and characters may be directly formed on the upper surface of the container main body 31 by die machining.

If the front side of the apparatus main body 10 where the user is standing face to face with the printer 1 upon replacing the toner container 30 is set to be a reference side, the indication information such as characters, symbols or dingbats displayed on the indicator 32 is oriented in a correct direction when viewed from front when the toner container 30 is properly mounted in the apparatus main body 10. In other words, the characters "ABCDE" are so printed as to be normally made out by the user reading from the front side of the apparatus main body 10. Thus, if the toner container 30 is properly mounted in the apparatus main body 10, the user can read the indication information of the indicator 32 in a correct direction from front. Therefore, the user can easily see or read the indication information and, if the toner container 30 is mounted in a wrong direction, such an error can be quickly noticed since the character information or the like is inverted.

In the printer 1 according to this embodiment, the window 152 is provided on the opening cover 132 constituting a part of the outer casing of the apparatus main body 10. Thus, external light can enter the apparatus main body 10 through the window 152. Since members susceptible to external light such as the photoconductive drum 21 are present in the apparatus main body 10, a light shielding structure (light shielding portion) for preventing the diffusion of incident light through the window 152 into the interior of the apparatus main body 10 is provided in the vicinity of the window 152. This light shielding structure is described with reference to FIG. 7.

Figure 7:
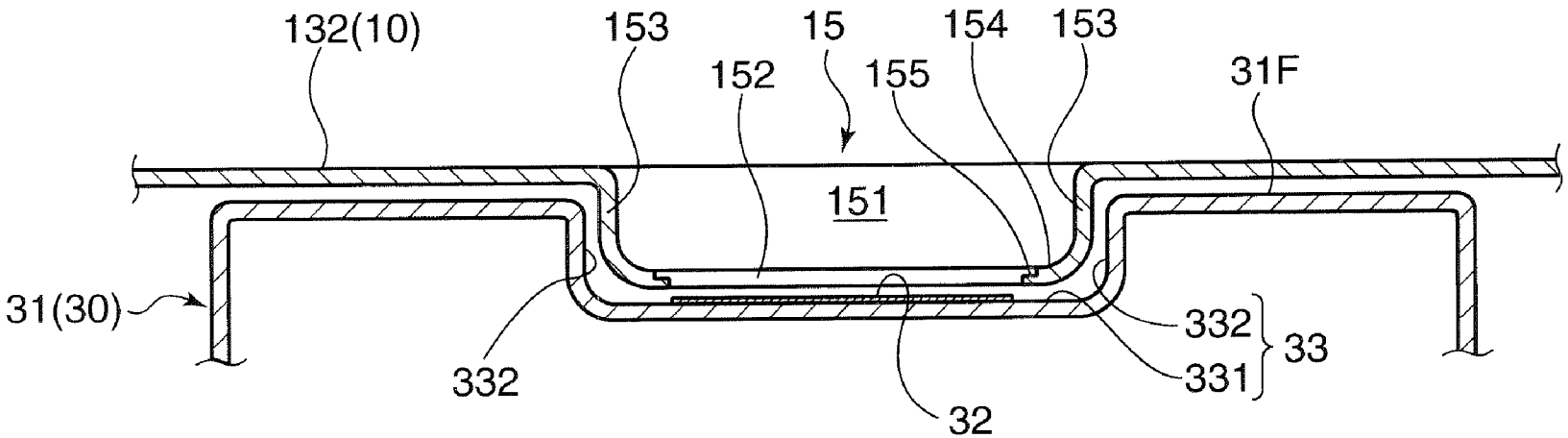
FIG. 7 is a section along VII-VII of FIG. 5.

FIG. 7 is a section along VII-VII of FIG. 5. It should be noted that the auxiliary tray 16 is not shown in FIG. 7 to simplify the drawing. As described above, the window 152 is provided at the bottom surface of the window recess 151 formed by recessing the part of the opening cover 132. The window recess 151 includes a side wall 153 extending in a recessing direction and a bottom wall 154 continuous with the side wall 153, and a transparent plate constituting the window 152 is fitted on an end edge 155 of the bottom wall 154.

The indicator recess 33 of the toner container 30 is provided on an upper surface 31F of the toner container 30 and includes a bottom surface 331 to which the seal constituting the indicator 32 is attached and a side wall 332 (light-blocking wall) continuous with the peripheral edge of the bottom surface 331. The indicator recess 33 has a triangular shape larger than the window recess 151 when viewed from above so as to be able to accommodate the window recess 151 and has such a depth as not to interfere with the window 152 with the opening cover 132 closed at a correct position.

The window 152 enters the indicator recess 33 beyond the upper surface 31F of the toner container 30 to come close to the bottom surface 331 (indicator 32) when the opening cover 132 is closed. The side wall 153 of the window recess 151 is opposed close to the side wall 332 of the indicator recess 33. Further, the underside of the opening cover 132 and the upper surface 31F of the toner container 30 are opposed close to each other. In other words, the indicator recess 33 and the window recess 151 projecting from the underside of the opening cover 132 are so shaped as to have directivities and the window recess 151 is accommodated inside the side wall 332 defining the indicator recess 33 when the toner container 30 is mounted in a correct installation direction.

Accordingly, external light incident through the window 152 is prevented from diffusing into the interior of the apparatus main body 10 by the bottom surface 331 of the indicator recess 33 close to the bottom wall 154, the side wall 332 close to the side wall 153 and the upper surface 31F close to the underside of the opening cover 132. On the other hand, toner particles may fly in the interior of the apparatus main body 10, but are unlikely to reach the lower surface of the window 152 due to the presence of the bottom surface 331, the side wall 332 and the upper surface 31F, whereby the smearing of the window 152 is suppressed.

Figure 8:
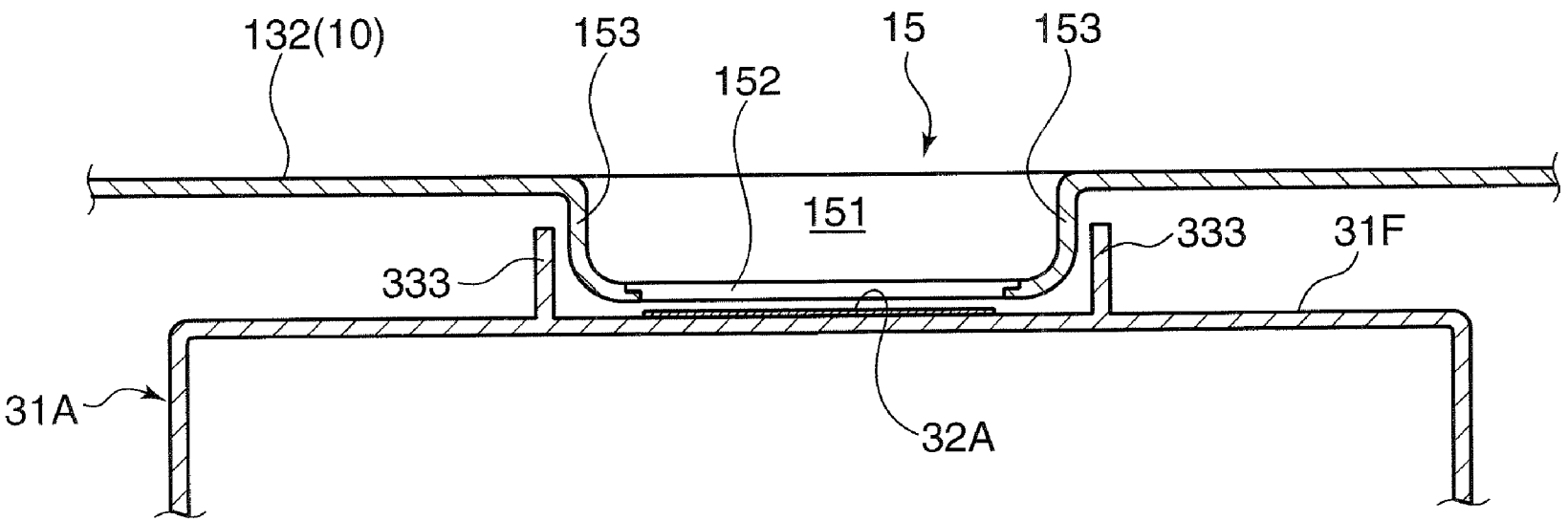
FIG. 8 is a section along VII-VII of FIG. 5 showing a modification.

FIG. 8 is a section along VII-VII of FIG. 5 showing another embodiment of the light-shielding structure. Here is shown an example in which a rib 333 (light shielding wall) stands on an upper surface 31F of a toner container 30A to surround the window recess 151 projecting from the underside of the opening cover 132. In other words, the rib 333 has a substantially triangular shape slightly larger than the window recess 151 when viewed from above. The rib 333 is opposed close to the side wall 153 of the window recess 151 when the opening cover 132 is closed. The toner container 30A provided with such a rib 333 has the aforementioned effects of shielding light and hindering flying toner particles.

Figure 9A:
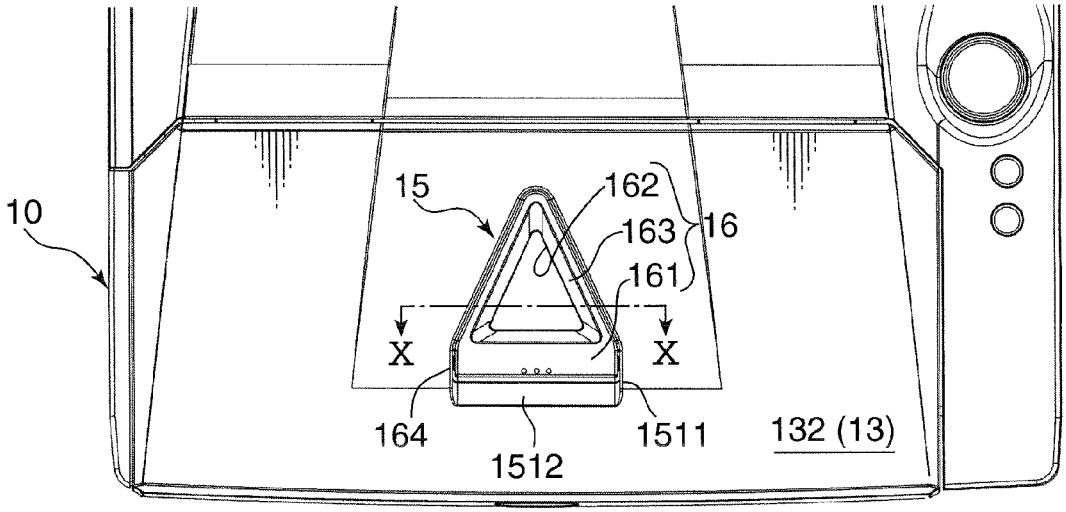
FIG. 9A is a top view of an auxiliary tray at an accommodated position and FIG. 9B is a top view of the auxiliary tray at an unfolded position.
Figure 9B:
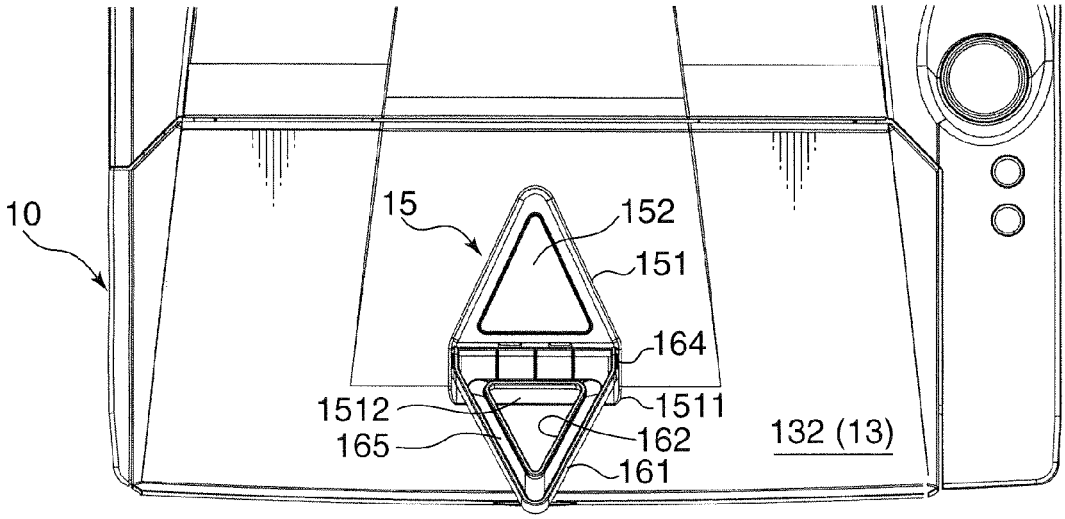
Figure 10:
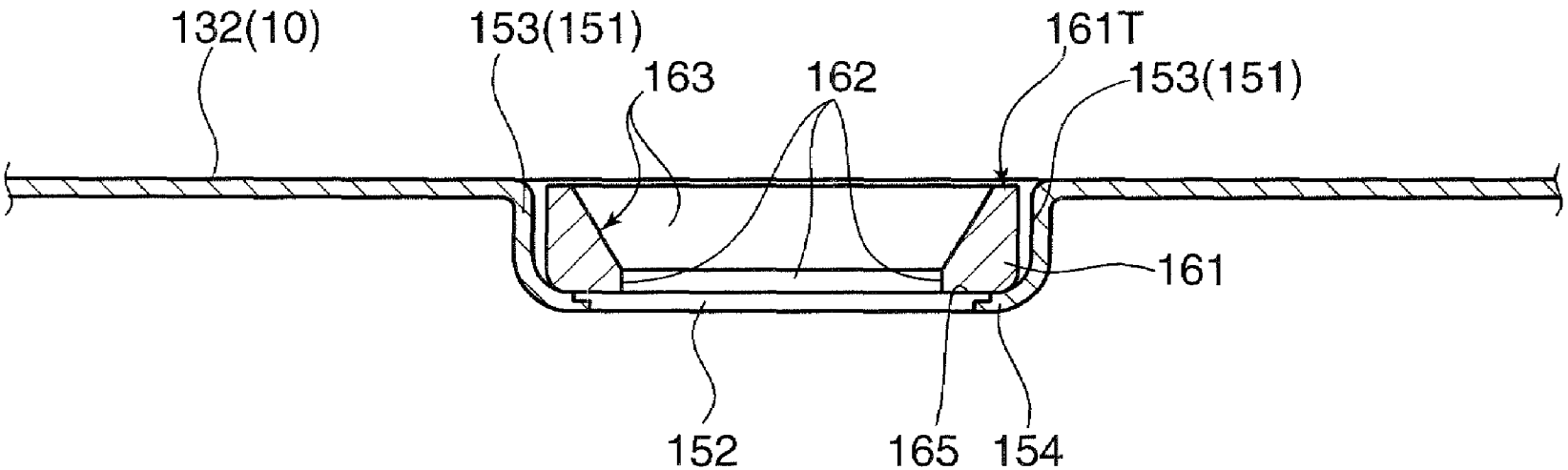
FIG. 10 is a section along X-X of FIG. 9A.

Next, the auxiliary tray 16 is described with reference to FIGS. 9A to 11. FIG. 9A is a top view showing an accommodated position where the auxiliary tray 16 is accommodated in a recess of the confirmation portion 15 (window recess 151), and FIG. 9B is a top view showing an unfolded position where the auxiliary tray 16 is lifted up and turned to support the leading end of a sheet discharged to the discharge unit 13 with respect to the sheet conveying direction. FIG. 10 is a section along X-X of FIG. 9A.

The auxiliary tray 16 is used to auxiliary support sheets upon discharging large-size sheets to the discharge unit 13 or upon better aligning sheets, in the form of a triangular frame and rotatably mounted on the confirmation portion 15 of the opening cover 132. As a result of disposing the auxiliary tray 16 on the confirmation portion 15, the auxiliary tray 16 is arranged at a position at a front side of a sheet in the conveying direction and in the widthwise center of the sheet receiving surface, i.e. at a position suited to auxiliary supporting the sheets. The auxiliary tray 16 includes a frame portion 161, an opening surrounding wall 162, slants 163, a rotary portion 164 and a sheet supporting surface 165.

The frame portion 161 is a triangular frame member engageable with the window recess 151 and having an opening inside. As shown in FIG. 10, the frame portion 161 has a thickness substantially equal to the depth of the window recess 151 and an upper surface 161T thereof is substantially flush with the upper surface of the opening cover 132 at the accommodated position. Accordingly, the leading end of the sheet discharged onto to the sheet receiving surface 130 will, in no likelihood, get caught by the auxiliary tray 16. Such a small clearance as not to impair the rotatability of the auxiliary tray 16 is defined between the outer surrounding wall of the frame portion 161 and the side wall 153 of the window recess 151.

The opening surrounding wall 162 is a triangular wall surface defining the above opening when viewed from above. This opening ensures the visibility of the window 152 upon mounting the auxiliary tray 16 utilizing the recess of the confirmation portion 15.

The slants 163 are inclined surfaces inclined down from the upper surface 161T of the frame portion 161 toward the opening surrounding wall 162. The slants 163 have a function of making the window 152 easier to see even in directions other than the one from right above. The window recess 151 tends to collect dust because of its concave surface. By providing the slants 163, the user can easily clean off not only dust remaining in the middle part of the window 152, but also dust remaining near the opening surrounding wall 162 of the window 152.

The rotary portion 164 is provided near the bottom side of the frame portion 161 and shaft-coupled to the parallel section 1511 of the window recess 151 to realize a lift-up and turning movement of the auxiliary tray 16. The auxiliary tray 16 is displaceable between the accommodated position where it is accommodated in the window recess 151 and the unfolded position where it auxiliary support sheets by being turned about the rotary portion 164.

Figure 11:
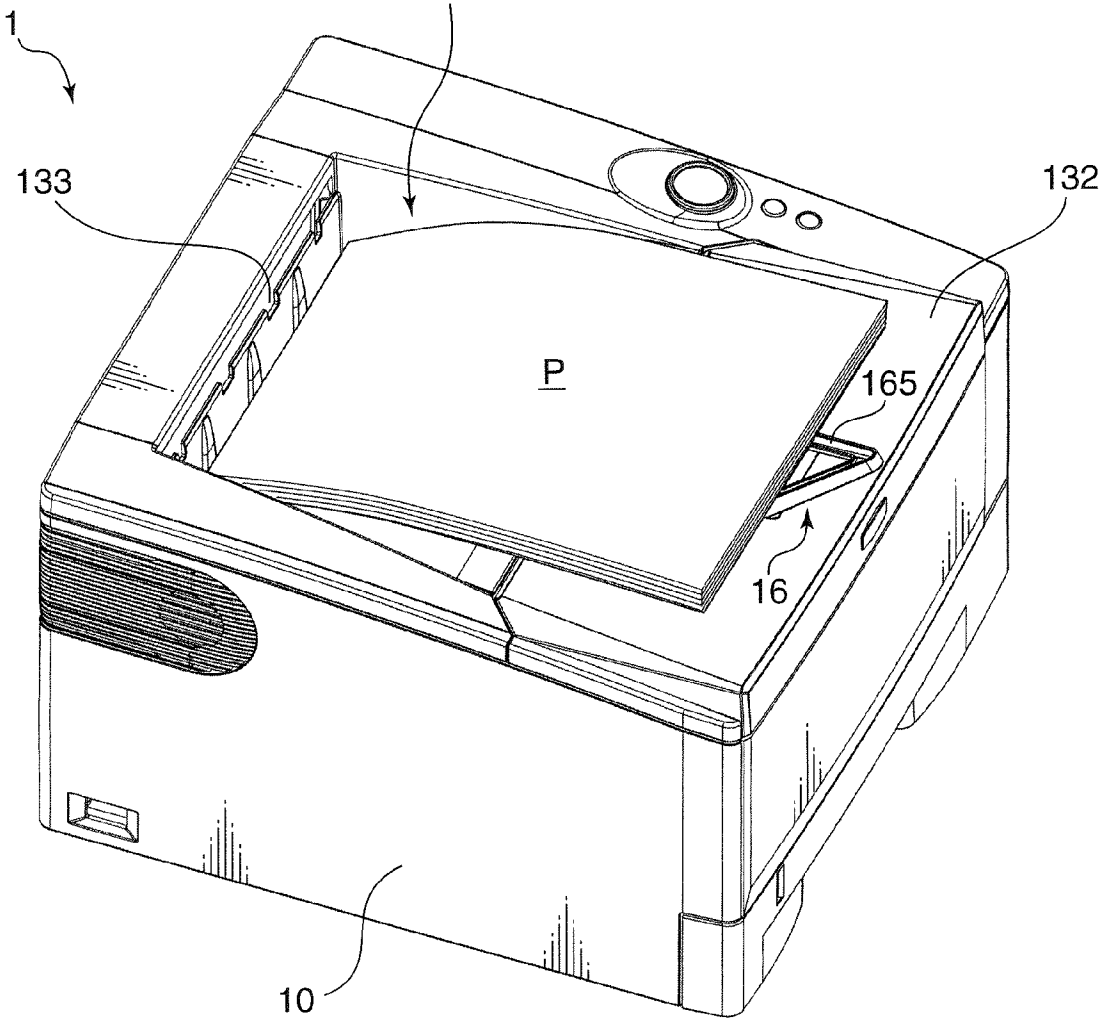
FIG. 11 is a perspective view showing a used state of the auxiliary tray.

The sheet supporting surface 165 is a triangular supporting surface located on the underside of the frame portion 161 for supporting sheets. As shown in FIG. 9B, the sheet supporting surface 165 appears on the upper surface of the discharge unit 13 while being at a specified angle to the sheet receiving surface 130 when the auxiliary tray 16 is at the unfolded position. At this time, the upper surface 161T of the frame portion 161 is in contact with the inclined surface 1512 of the window recess 151 and the auxiliary tray 16 is in a stable state. Then, the sheet supporting surface 165 supports sheets P discharged to the discharge unit 13 as shown in FIG. 11. On the other hand, when the auxiliary tray 16 is at the accommodated position, the sheet supporting surface 165 is in contact with the bottom wall 154 of the window recess 151.

The user can normally accommodate the auxiliary tray 16 constructed as above in the window recess 151 and lift up and turn it to the unfolded position if necessary to support sheets discharged to the discharge unit 13. Since the auxiliary tray 16 is accommodated utilizing the confirmation portion 15, it is not necessary to separately ensure an accommodation space for the auxiliary tray 16. In addition, since the auxiliary tray 16 is formed with the opening, the visibility of the window 152 is not impaired. This auxiliary tray 16 can also be used as a grip upon opening the opening cover 132.

According to the printer 1 of this embodiment constructed as above, the user can confirm the indication information displayed on the indicator 32 of the toner container 30 through the window 152 from the outside of the printer 1. Thus, the user can know which toner container 30 is actually mounted in the apparatus main body 10 without opening the opening cover 132 extra. Hence, the user can quickly understand the model number of the toner container 30 and other necessary information, for example, at the time of ordering a new toner container 30 or requesting maintenance, wherefore user convenience can be improved.

Here, the image forming assembly including the photoconductive drum 21 might be influenced by external light because the outer casing of the apparatus main body 10 is provided with the window 152. However, the light shielding structure of fitting the projecting part of the window recess 151 into the indicator recess 33 of the toner container 30 when the opening cover 132 is closed is adopted in this embodiment. Accordingly, the side wall 332 mainly functions as a light shielding wall and the diffusion of external light into the interior of the apparatus main body 10 can be suppressed. Such a light shielding structure can also suppress the adhesion of toner particles, which might be flying in the apparatus main body 10, to the window 152.

Further, the window 152 is provided at the bottom surface of the window recess 151 and arranged at a position slightly lower than the sheet receiving surface 130. Thus, external forces are unlikely to act on the window 152 and scratches and smearing can be suppressed, wherefore the visibility of the window 152 can be ensured in a satisfactory manner over a long term.

Further, the window 152 is provided in the widthwise middle part of the opening cover 132 arranged at the leading end side in the sheet conveying direction and the apex 152T of the window recess 152 (apex 151T of the window recess 151) is located in the widthwise center of the sheet receiving surface 130. Thus, the user can utilize the window 152 (apex 152T) as a center indicator and can know the widthwise center position of a sheet discharged to the discharge unit 13.

Further, the auxiliary tray 16 can be assembled utilizing the confirmation portion 15 (window recess 151), can be normally accommodated in the window recess 151 and can auxiliary support sheets by being turned according to needs. Further, the auxiliary tray 16 is formed with the opening to ensure the visibility of the window 152. Since the recess of the sheet receiving surface 130 provided for the window 152 is effectively utilized in this way, it is not necessary to ensure a separate accommodation space for the auxiliary tray 16. Further, the design of the sheet receiving surface 130 does not look complicated.

The printer 1 according to the embodiments of the present invention is described above, but the present invention is not limited thereto. For example, the present invention may be embodied as follows.

[1] The printer is illustrated as an example of the image forming apparatus in the above embodiment. It goes without saying that the present invention is also applicable to copiers, facsimile machines, complex machines of these and other image forming apparatuses.

[2] Although the window 152 is provided in the widthwise center of the opening cover 132 in the above embodiment, it may not necessarily be provided in the widthwise center. Further, another window may be provided in addition to the window 152 having the auxiliary tray 16 assembled therewith. For example, a window may be provided on the front surface of the apparatus main body (outer surface of the manual sheet feeder 12 in the above embodiment). It is preferable to arrange an illumination device in the vicinity of the window 152 so as to improve the visibility of the window 152 even in a dark place.

[3] In the above embodiment, the auxiliary tray 16 is provided with the opening as the transparent portion for ensuring the visibility of the window 152. A transparent plate, a transparent film, a slit plate or the like may be mounted at this opening. Instead of providing the auxiliary tray 16 with the opening, a transparent triangular plate may be used as the auxiliary tray 16.

[4] In the above embodiments, the indicator 32 of the toner container 30 is triangular and printed with characters and dingbats as indication information. The shape of the indicator 32 is arbitrary and may be one of various shapes having directivities other than triangular shapes or one of various shapes having no directivity. Further, the shape of the window 152 and that of the indicator 32 of the toner container 30 may not necessarily conform to each other.

The indication information preferably includes at least one of characters, a symbol and a dingbat, but may be mere color information or the like. In order to improve the visibility of the indicator 32 in a dark plate, the indicator 32 may be made of a fluorescent or light storing material or may be formed by a luminescent or thermosensitive panel or the like.

A part of the toner container 30 (consumable supplying member) having no particular indication information may serve as a visual confirmation portion. In other words, a part of the outer surface of the toner container 30 (container main body 31) may be made visible through the window 152 without particularly providing the toner container 30 with the indicator 32 as shown in the above embodiment. Alternatively, the window 152 may be provided at a position where a part other than the toner container 30 is visible.

[5] In the above embodiments, the engaging structure of the indicator recess 33 and the window recess 151 is illustrated as the light shielding structure. Instead, the light shielding structure may, for example, be such that the window recess 151 is surrounded by a spongy lightproof sealing member having a light shielding property on the underside of the opening cover 132 and the projecting end of the lightproof sealing member is held in contact with or in proximity to the upper surface of the toner container 30.

[6] In the above embodiments, the electrophotographic printer 1 and the toner container 30 to be mounted therein are illustrated as examples of the image forming apparatus and the consumable supplying member. Besides, the present invention is also applicable, for example, to ink-jet printers and ink cartridges mounted therein. Further, the present invention is widely applicable to various household apparatuses, various industrial electric/mechanical apparatuses and the like and consumable supplying members mounted therein.

The specific embodiment described above mainly embraces inventions having the following constructions.

An image forming apparatus according to one aspect of the present invention comprises an apparatus main body having a casing structure and adapted to perform an image forming operation; a sheet receiving surface constituting a part of the casing structure and adapted to receive a sheet discharged after an image forming process is performed in the apparatus main body; a window provided on the sheet receiving surface for enabling a part of the interior of the apparatus main body to be seen; and an auxiliary tray attached to the sheet receiving surface and displaceable between an unfolded position to auxiliary support a discharged sheet and an accommodated position to be accommodated in the sheet receiving surface, wherein the window is provided at a bottom surface of a recess formed by recessing a part of the sheet receiving surface, and the auxiliary tray is accommodated in the recess when being located at the accommodated position and includes a transparent portion for ensuring the visibility of the window.

According to such an image forming apparatus, a user can see the part of the interior of the apparatus main body through the window provided on the apparatus main body. Thus, the user can know a state inside such as which members are actually mounted in the apparatus main body without opening an opening cover or the like. Since the auxiliary tray is to be accommodated in the recess including the window, it is not necessary to separately provide an accommodation space for the auxiliary tray and it can be avoided to make the sheet receiving surface look complicated even if the auxiliary tray and the window are provided on the sheet receiving surface.

In the above construction, it is preferable that the auxiliary tray includes a frame portion shaped to be engageable with the recess and an opening formed inside the frame portion; and that the frame portion has a thickness substantially equal to the depth of the recess.

According to this construction, the upper surface of the frame portion is substantially in flush with the sheet receiving surface without projecting therefrom when the auxiliary tray is at the accommodated position. Thus, there is no likelihood that the leading end of a sheet discharged onto the sheet receiving surface gets caught by the auxiliary tray.

In this case, a slant inclined downward toward the opening is preferably formed on a surface of the frame portion to become an outer surface when the frame portion is at the accommodated position.

According to this construction, since the above slant is formed, the widow can be seen in a direction other than the one from right above even if the auxiliary tray is to be accommodated in the recess where the window is provided. Further, dust and the like tend to be collected in the recess, but the user can easily clean the dust and the like remaining in the recess since the slant is provided.

In this construction, it is preferable that a consumable supplying member to be detachably mounted in the apparatus main body is further provided; and that the window enables a part of the consumable supplying member to be seen with the consumable supplying member mounted in the apparatus main body.

According to this construction, the user can see the part of the consumable supplying member through the window provided on the apparatus main body. Thus, the user can know which consumable supplying member is actually mounted in the apparatus main body without opening the opening cover or the like.

In this case, it is preferable that the apparatus main body includes a developing mechanism inside; and that the consumable supplying member is a toner container for supplying toner to the developing mechanism.

According to this construction, the user can know which toner container is actually mounted in the apparatus main body without opening the opening cover or the like.

Further, in this case, an indicator for displaying specified indication information is preferably provided in a part or the entirety of a visual confirmation portion of the toner container.

According to this construction, the user can confirm the indication information displayed on the toner container through the window. Thus, the user can easily identify the mounted toner container based on the indication information.

In the above construction, the recess is preferably provided at a front side of a sheet to be discharged onto the sheet receiving surface in a sheet conveying direction and near the widthwise center of the sheet receiving surface.

According to this construction, by arranging the recess as above, the auxiliary tray can also be arranged at the front side of the sheet to be discharged onto the sheet receiving surface in the sheet conveying direction and in the widthwise center of the sheet receiving surface. Thus, the auxiliary tray can be arranged at a position suited to auxiliary supporting the sheet. In addition, the user can recognize the widthwise center position of a sheet (sheet stack) using the recess as a marker.

In this case, the recess and/or the auxiliary tray preferably have a symmetric shape with an apex faced toward a back side of the sheet receiving surface in the sheet conveying direction.

According to this construction, the widthwise center position of a sheet stack can be displayed by a simple and comprehensive shape. Further, since the center indicator has the symmetric shape with the apex faced toward the back side of the sheet receiving surface in the sheet conveying direction, design can be improved.

In the above construction, the window preferably serves as a center indicator indicating the widthwise center position of a sheet discharged onto the sheet receiving surface.

According to this construction, the user can recognize the widthwise center position of a sheet (sheet stack) using the window as a marker. Thus, the user can remove the sheet in a well-balanced manner by grabbing the recognized widthwise center position of the sheet.

In this case, the window preferably has a symmetric shape with an apex faced toward the back side of the sheet receiving surface in the sheet conveying direction and arranged at the widthwise center position of a sheet to be discharged onto the sheet receiving surface.

According to this construction, the widthwise center position of a sheet stack can be displayed by a simple and comprehensive shape. Further, since the center indicator has the symmetric shape with the apex faced toward the back side of the sheet receiving surface in the sheet conveying direction, design can be improved.

As described above, according to the image forming apparatus of the present invention, the user can know which members are actually mounted in the apparatus main body from the outside of the image forming apparatus main body. Thus, for example, at the time of ordering a toner container or requesting maintenance, the necessary model number of the toner container or the like can be quickly grasped, whereby user convenience can be improved. Further, since the auxiliary tray is to be accommodated in the recess including the window, even if the auxiliary tray and the window are provided on the sheet receiving surface, it can be avoided to make the sheet receiving surface look complicated and design can be improved.

This application is based on patent application Nos. 2007-002460 and 2007-002461 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus, comprising:

an apparatus main body having a casing structure and adapted to perform an image forming operation;

a sheet receiving surface constituting a part of the casing structure and adapted to receive a sheet discharged after an image forming process is performed in the apparatus main body;

a window provided on the sheet receiving surface for enabling a part of the interior of the apparatus main body to be seen; and an auxiliary tray attached to the sheet receiving surface and displaceable between an unfolded position to auxiliary support a discharged sheet and an accommodated position to be accommodated in the sheet receiving surface, wherein:

the window is provided at a bottom surface of a recess formed by recessing a part of the sheet receiving surface, and the auxiliary tray is accommodated in the recess when being located at the accommodated position and includes a transparent portion for ensuring the visibility of the window.

2. An image forming apparatus according to claim 1, wherein:

the auxiliary tray includes a frame portion shaped to be engageable with the recess and an opening formed inside the frame portion; and the frame portion has a thickness substantially equal to the depth of the recess.

3. An image forming apparatus according to claim 2, wherein a slant inclined downward toward the opening is formed on a surface of the frame portion to become an outer surface when the frame portion is at the accommodated position.

4. An image forming apparatus according to claim 1, further comprising a consumable supplying member to be detachably mounted in the apparatus main body, wherein the window enables a part of the consumable supplying member to be seen with the consumable supplying member mounted in the apparatus main body.

5. An image forming apparatus according to claim 4, further comprising a developing mechanism provided in the apparatus main body, wherein the consumable supplying member is a toner container for supplying toner particles to the developing mechanism.

6. An image forming apparatus according to claim 5, wherein an indicator for displaying specified indication information is provided in a part or the entirety of a visual confirmation portion of the toner container.

7. An image forming apparatus according to claim 1, wherein the recess is provided at a front side of a sheet to be discharged onto the sheet receiving surface in a sheet conveying direction and near the widthwise center of the sheet receiving surface.

8. An image forming apparatus according to claim 7, wherein the recess and/or the auxiliary tray have a symmetric shape with an apex faced toward a back side of the sheet receiving surface in the sheet conveying direction.

9. An image forming apparatus according to claim 1, wherein the window serves as the center indicator indicating the widthwise center position of a sheet discharged onto the sheet receiving surface.

10. An image forming apparatus according to claim 9, wherein the window has a symmetric shape with an apex faced toward the back side of the sheet receiving surface in the sheet conveying direction and arranged at the widthwise center position of a sheet to be discharged onto the sheet receiving surface.

* * * * *